US007413035B1

(12) United States Patent
Miller

(10) Patent No.: US 7,413,035 B1
(45) Date of Patent: Aug. 19, 2008

(54) REUSABLE AUGER BARREL

(76) Inventor: Tony Bryon Miller, 100 Miller La., Russellville, KY (US) 42276

( * ) Notice: Subject to any disclaimer, the term of this patent is extended or adjusted under 35 U.S.C. 154(b) by 122 days.

(21) Appl. No.: 11/026,586

(22) Filed: Dec. 30, 2004

(51) Int. Cl.
*E21B 7/20* (2006.01)

(52) U.S. Cl. ..... 175/171; 175/257; 175/262; 405/243; 405/249; 405/257

(58) Field of Classification Search ..... 175/19, 175/20, 171, 257, 262; 405/216, 243, 249, 405/257; 249/48, 51
See application file for complete search history.

(56) References Cited

U.S. PATENT DOCUMENTS

| | | | | |
|---|---|---|---|---|
| 1,118,575 A | | 11/1914 | Opfergelt | |
| 2,139,929 A | | 12/1938 | Blow | |
| 2,576,799 A | * | 11/1951 | McKinstry | 175/171 |
| 2,897,553 A | * | 8/1959 | Gorrow | 405/216 |
| 3,744,578 A | | 7/1973 | Lisenby | 175/23 |
| 3,894,589 A | | 7/1975 | Ciraud | 175/23 |
| 6,142,712 A | * | 11/2000 | White et al. | 405/249 |
| 6,425,713 B2 | | 7/2002 | Fox et al. | 405/243 |
| 2003/0039513 A1 | | 2/2003 | Fox et al. | 405/243 |

* cited by examiner

*Primary Examiner*—Richard E. Chilcot, Jr.
*Assistant Examiner*—Matt J Smith
(74) *Attorney, Agent, or Firm*—Waddey & Patterson, P.C.; Phillip E. Walker

(57) ABSTRACT

An apparatus that facilitates the insertion of a stanchion into the ground. The apparatus comprises a first side including a plurality of connection apertures, a second side including a plurality of connection apertures, and at least one connector engaging the connection apertures to removably engage the first side to the second side. The first and second sides reposition the ground and substantially separate the stanchion from the ground during insertion. Additionally, the apparatus maintains the integrity of the hole into which the stanchion is placed during insertion of the stanchion into the ground. Preferably, the first and second sides define a substantially circular opening when engaged to one another. Additionally, each side includes a length and the connector substantially spans the length and vertically connects the first side to the second side along the length.

16 Claims, 7 Drawing Sheets

REUSABLE AUGER BARREL

BACKGROUND OF THE INVENTION

The present invention is generally related to devices for aiding in boring into the ground. More specifically, the present invention relates to a support structure used to maintain the circumferential integrity of a hole as the earth is removed from the core of the hole, such as in the insertion of supports into the ground.

It will be appreciated by those skilled in the art that numerous devices have been developed to assist in the art of moving earth moving. Specifically, devices have been developed to assist in the drilling of wells and the implementing of poles into the ground. For example, U.S. Pat. Nos. 1,118,575, 2,139,929, 3,744,578, 3,894,589, and 6,425,713, as well as U.S. Patent Application Publication No. 2003/0039513, disclose such devices or methods for attempting to accomplish the same.

These patents and publications have numerous faults and are not directed towards the insertion of a pole within the ground where it is desired to remove the implanting equipment before completely setting the pole. For example, U.S. Pat. No. 3,894,589 uses a tubular sleeve that is implemented and remains in the ground and while a pole is inserted into the sleeve thereby leaving the sleeve in the ground. Additionally, U.S. Pat. No. 1,118,575 discloses a well boring apparatus that is not used in combination with a pole and requires unified removal of the apparatus for access to the well bored.

What is needed then is an apparatus that is used to maintain the circumference of a hole while the filler substance within the hole is removed so a pole can then be inserted. The needed apparatus should maintain the integrity of the hole and should be easily removable from the hole after insertion of the pole to enable reuse of the apparatus. This needed apparatus is lacking in the art.

BRIEF SUMMARY OF THE INVENTION

Included herein is an apparatus that facilitates the insertion of a stanchion into the ground. The apparatus comprises a first side including a plurality of connection apertures, a second side including a plurality of connection apertures, and at least one connector engaging the connection apertures to removably engage the first side to the second side. The first and second sides reposition the ground and substantially separate the stanchion from the ground during insertion. Additionally, the apparatus maintains the integrity of the hole into which the stanchion is placed during insertion of the stanchion into the ground.

In a preferred embodiment, the first and second sides define a substantially circular opening when engaged to one another. Each side includes a length and the connector substantially spans the length and vertically connects the first side to the second side along the length.

Engagement between the first and second sides defines a substantially circular opening and forms a perimeter on which the connector is positioned. Two connectors are positioned substantially opposite each other on the perimeter to vertically connect the first side to the second side. Each side further includes a boring edge for boring into the ground and facilitating the placement of the apparatus into the ground.

The apparatus further comprises a top removably engaging each side where the top includes at least one protrusion shaped to removably engage at least one notched opening positioned on each side. Alternately, each side can include at least one protrusion and the top can include an aperture shaped to removably engage the protrusions on each side. Preferably, the top imparts rotational movement to each side to facilitate the boring of the apparatus into the ground.

Also included is a removable casing for the insertion of a pole into the ground. The removable casing comprises first and second sides and first and second connectors. The first and second sides each have a substantial semicircular shape, a first and a second vertical edge, and a first and a second set of connection apertures positioned proximate to each vertical edge. The first connector engages the first set of connection apertures while the second connector engages the second set of connection apertures such that the first and second connectors removably attach the first side to the second side.

Additionally, the first and second sides reposition the ground and substantially separate the pole from the ground during insertion. The removal of the connectors allows independent movement of the first and second sides. Alternately stated, the disengagement of the first and second connectors from the first and second sides allows independent removal of each side from the ground.

Also included is a removable top engaging each side wherein the top includes a plurality of protrusions shaped to removably engage at least one securing location positioned on each side. The top imparts rotational movement to each side and, in conjunction with a boring edge positioned on each side, facilitates the boring of the removable casing into the ground.

The current invention facilitates the implanting of a pole into the ground through maintaining the integrity and circumference of a hole during the removal of the ground within that circumference. Additionally the current invention facilitates the implanting of this pole into the ground by the independent removal of portions of the apparatus. Specifically, the independent removal of these pieces preferably do not have to be lifted over the pole and only need to clear the surface of the ground in order to be removed from the work area. As such, the current invention facilitates the removal of itself from the work area through its separation of its individual pieces from other pieces, especially along a vertical line.

Additionally, an apparatus made in accordance with the current disclosure is ideally suited for a situation where the ground is soft and/or loose such that continued boring cause adjacent material to fall into the boring area. This fall of material from the surrounding ground increases the overall circumference of the hole. As such, a hole dug in this soft and/or loose ground without the present invention weakens the surrounding area around the hole and increases the dig time to create the hole and the fill time required to properly pack the pole and place it in the ground.

It is therefore a general object of the present invention to provide an apparatus used to facilitate the insertion of a stanchion into the ground.

It is also an object of the present invention to provide a removable casing used to facilitate the insertion of a pole into the ground.

Another object of the present invention is to provide a removable casing that can be easily removed from a hole after the insertion of a pole into the hole.

Still another object of the present invention is to provide a removable casing used to insert a pole into the ground wherein the removable casing, can be separated along vertical lines.

Another object of the present invention is to provide a removable casing that maintains the integrity of a hole during the removal of the material that comprised the hole.

Other and further objects, features and advantages of the present invention will be readily apparent to those skilled in the art upon reading of the following disclosure when taken in conjunction with the accompanying drawings.

BRIEF DESCRIPTION OF THE SEVERAL VIEWS OF THE DRAWINGS

FIG. 6 is a cross-sectional side view through the center of an embodiment of the apparatus shown with the sides of the apparatus placed in the ground and the top removed from the apparatus.

FIG. 7 shows an external side view of an embodiment of the apparatus and a device for the removal of the core material from the hole.

FIG. 8 shows a pole inserted within the removable casing and the connector removed from the apertures of the first and second sides.

FIG. 9 shows the independent removal of one side of the removable casing.

FIG. 10 shows the independent removal of the other side of the removable casing leaving the pole in the ground.

DETAILED DESCRIPTION OF THE INVENTION

Figure 1:
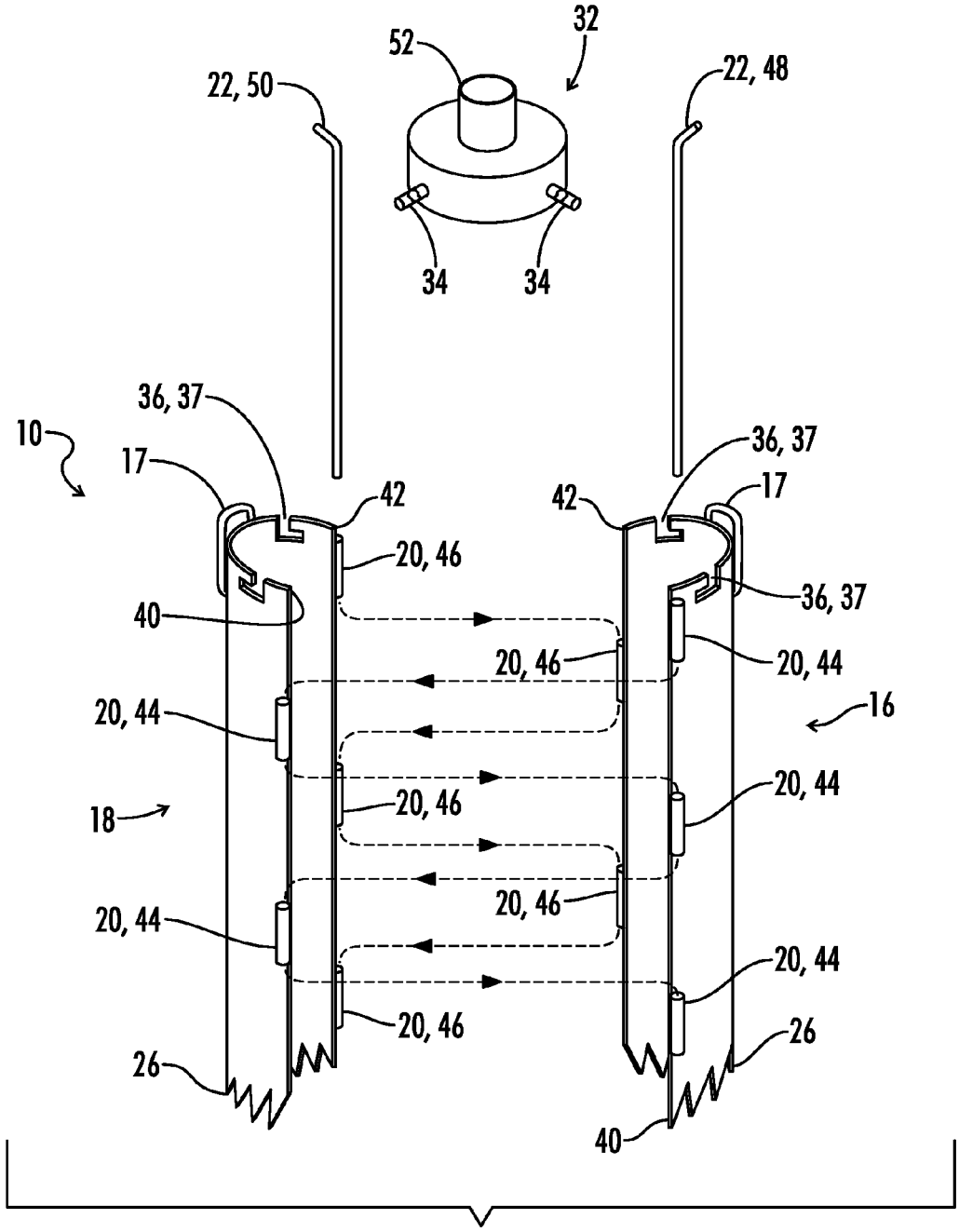
FIG. 1 is an expanded perspective view of an embodiment of an apparatus made in accordance with the current disclosure.
Figure 2:
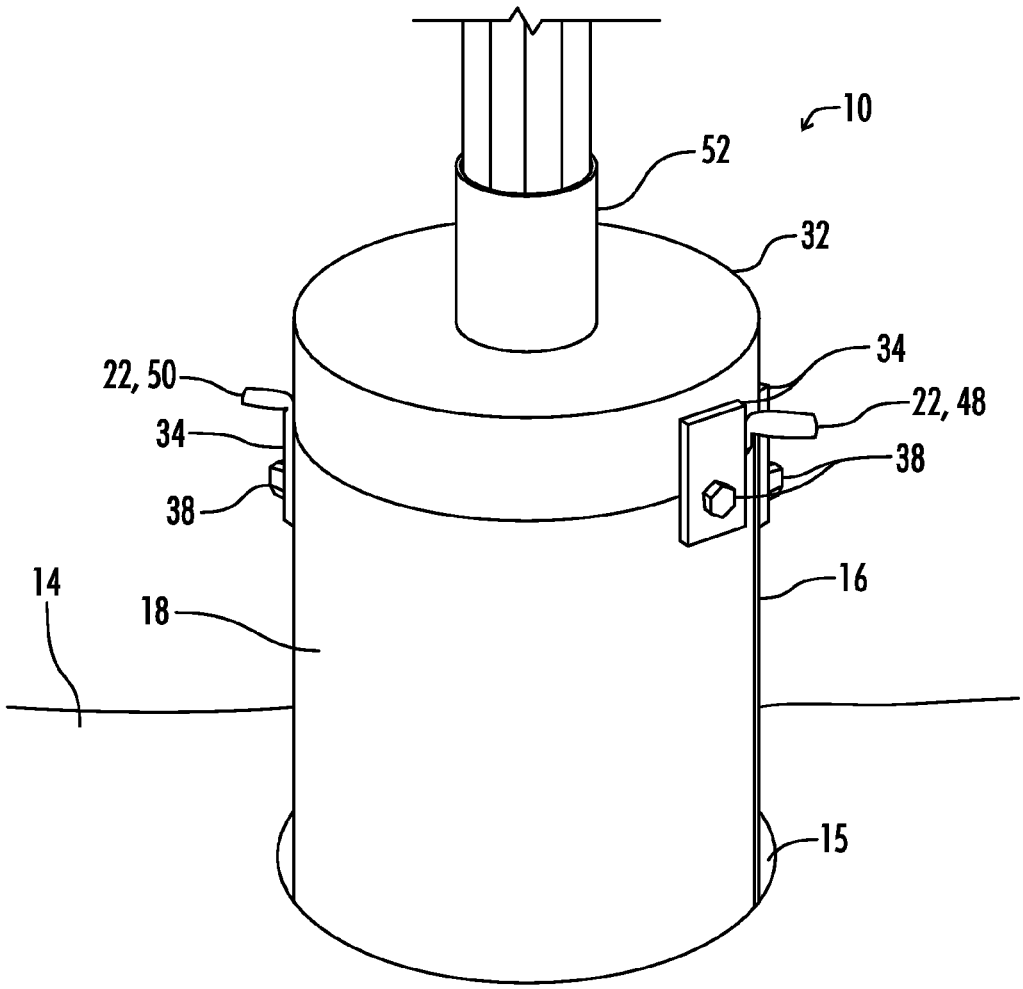
FIG. 2 is a perspective view showing the insertion into the ground of one embodiment of an apparatus made in accordance with the current disclosure.
Figure 3:
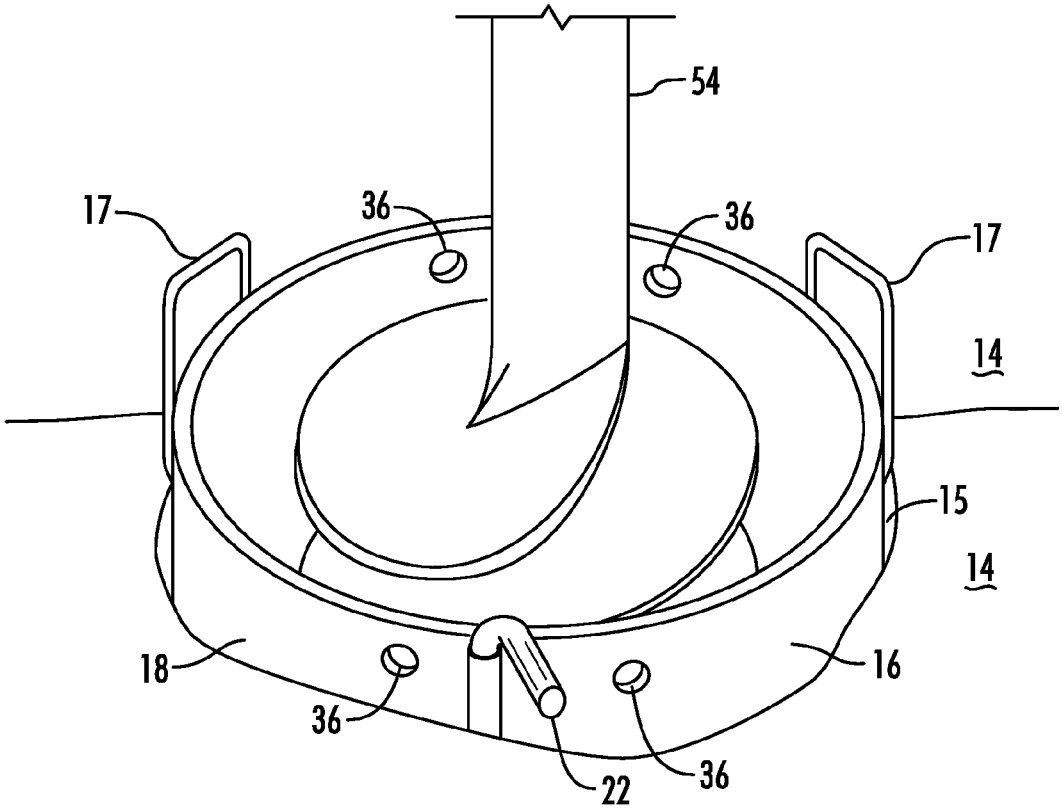
FIG. 3 is a perspective view of an alternate embodiment of the apparatus shown with the top removed and the core material being removed.
Figure 4:
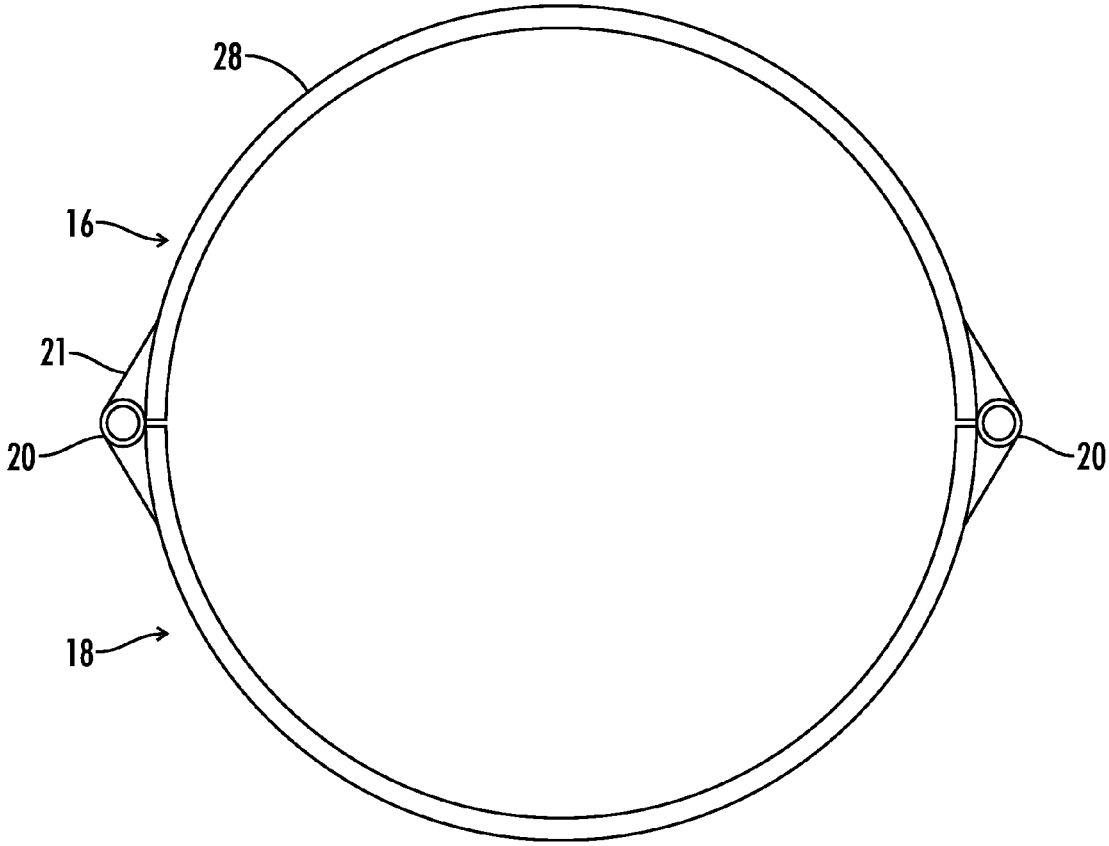
FIG. 4 shows a top view of one embodiment of the apparatus.
Figure 5:
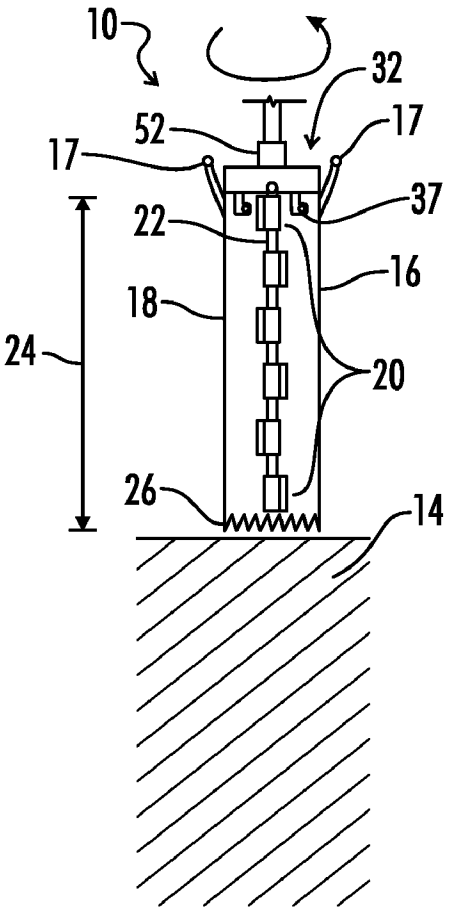
FIG. 5 shows a side view of one embodiment of the apparatus prior to its facilitation of the insertion of a pole into the ground.
Figure 6:
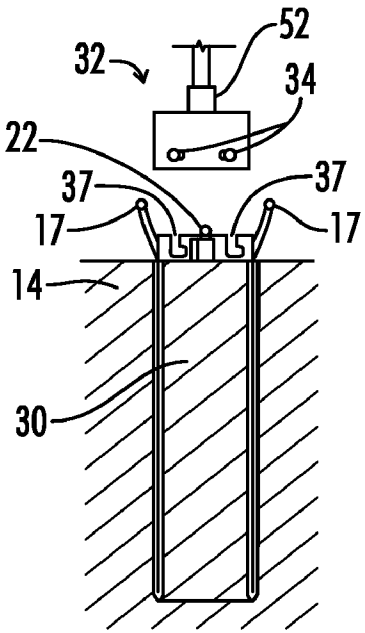
FIG. 6 shows a side view similar to FIG. 5.
Figure 7:
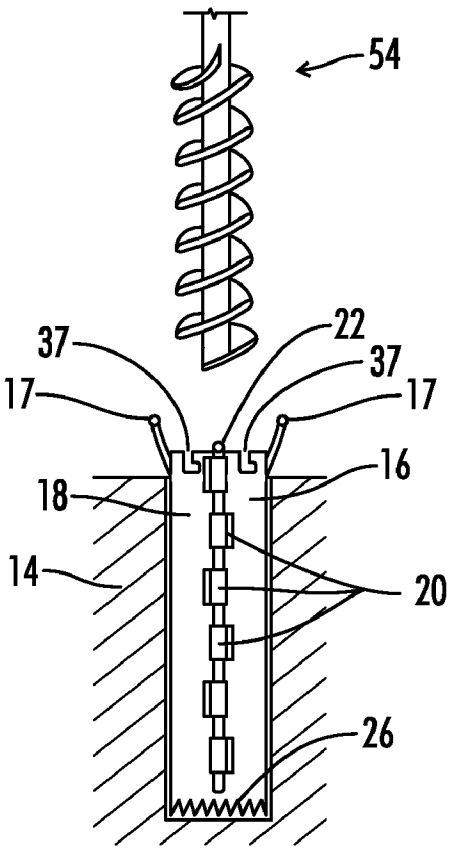
FIG. 7 is a side view similar to FIGS. 5 and 6.
Figure 10:
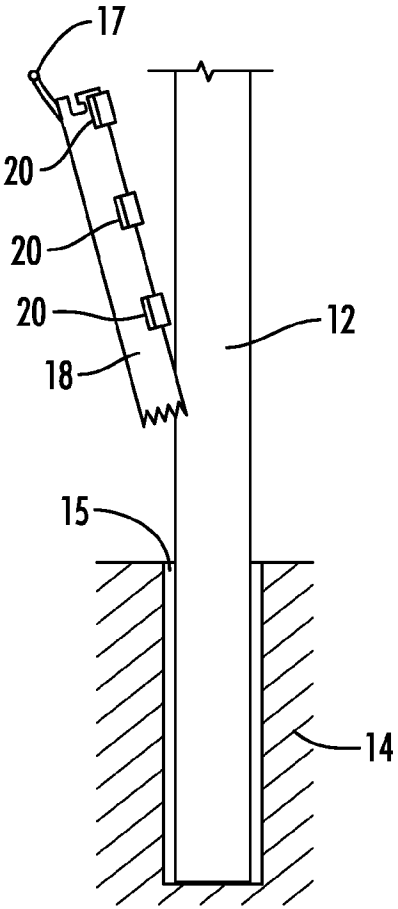
FIG. 10 is a side view similar to FIGS. 5-9.
Figure 9:
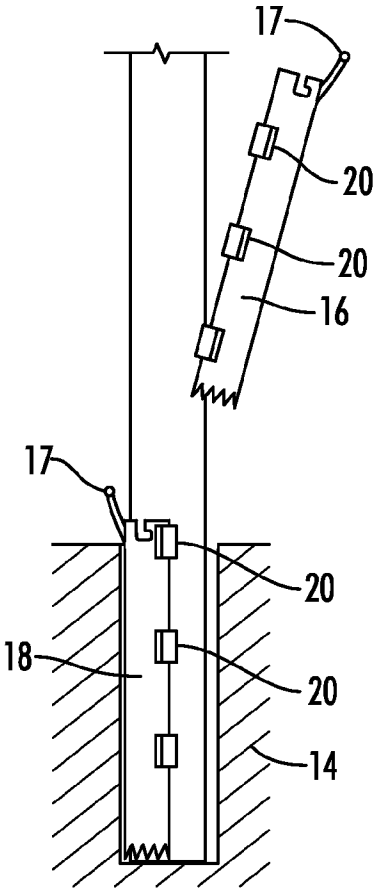
FIG. 9 is a side view similar to FIGS. 5-8.
Figure 8:
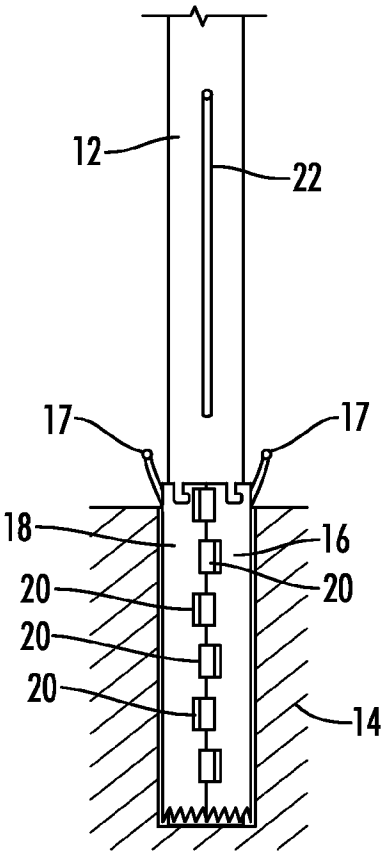
FIG. 8 is a side view similar to FIGS. 5-7.

Referring generally now to FIGS. 1-11, an apparatus of the present invention is generally shown and designated by the numeral 10. The apparatus (10) is for the insertion of a stanchion (12) into the ground (14). The apparatus (10), which can also be described as a removable casing (10) facilitates the placement of a stanchion (12), which can also be described as a pole (12) into the ground (14). The apparatus (10) comprises a first side (16) and a second side (18). Each side (16 and 18) includes a plurality of connection apertures (20). Additionally, at least one connector (22) engages the connection apertures (20) to removably engage the first side (16) to the second side (18). The first and second sides (16 and 18) reposition the ground (14) and substantially separate the stanchion (12) from the ground (14) during insertion of the stanchion (12) into the ground (14).

Preferably, the first and second sides (16 and 18) define a substantially circular opening when engaged. Additionally, each side (16 and 18) includes a length (24) and a boring edge (26). The connector (22) substantially spans the length (24) and vertically connects the first side (16) and second side (18) along the length (24). The boring edge (26) includes rock teeth used to drive into the ground and cut the rocks that may be positioned in the ground (14). More preferably, there are two connectors (22) positioned substantially opposite each other on the perimeter (28).

The number of connection apertures (20), and the length of each connection apertures (20) can vary according to the use of the apparatus (10). In a preferred embodiment, there are four connection apertures (20), each approximately one foot long, along the length (24) of the apparatus (10). Specifically, in this preferred embodiment there are two connection apertures (20) positioned on each vertical edge (40 and 42) of each side (16 and 18). As such, in this embodiment each connector (22) will pass through four connection apertures (20) to removably secure the first and second sides (16 and 18). An alternate number and arrangement of connection apertures (20) can be used and still maintain the scope of the current invention.

The first and second sides (16 and 18) form a perimeter that can maintain the integrity of the hole (15) in the ground (14) into which the stanchion (12) is positioned. The first and second sides (16 and 18) separate the internal material (30) that is to be removed to create the hole (15) from the external ground (14). This separation can be very useful when a hole is desired to be made in soft or loose ground, where without such an apparatus (10) the boring process used to create the hole (15) could take a substantial amount of time, if not be futile.

Preferably, the connector (22) is positioned on the perimeter (28). However, the specific location of the connector (22) with respect to the perimeter (28) can vary according to application and thickness of the first and second sides (16 and 18). For example, in a first embodiment, the connector (22) can be positioned internally to the perimeter (28), while in alternate embodiments the connector and corresponding apertures (20) can be positioned on the external portion of the perimeter (28) or within the walls that comprise the perimeter (28).

Figure 11:
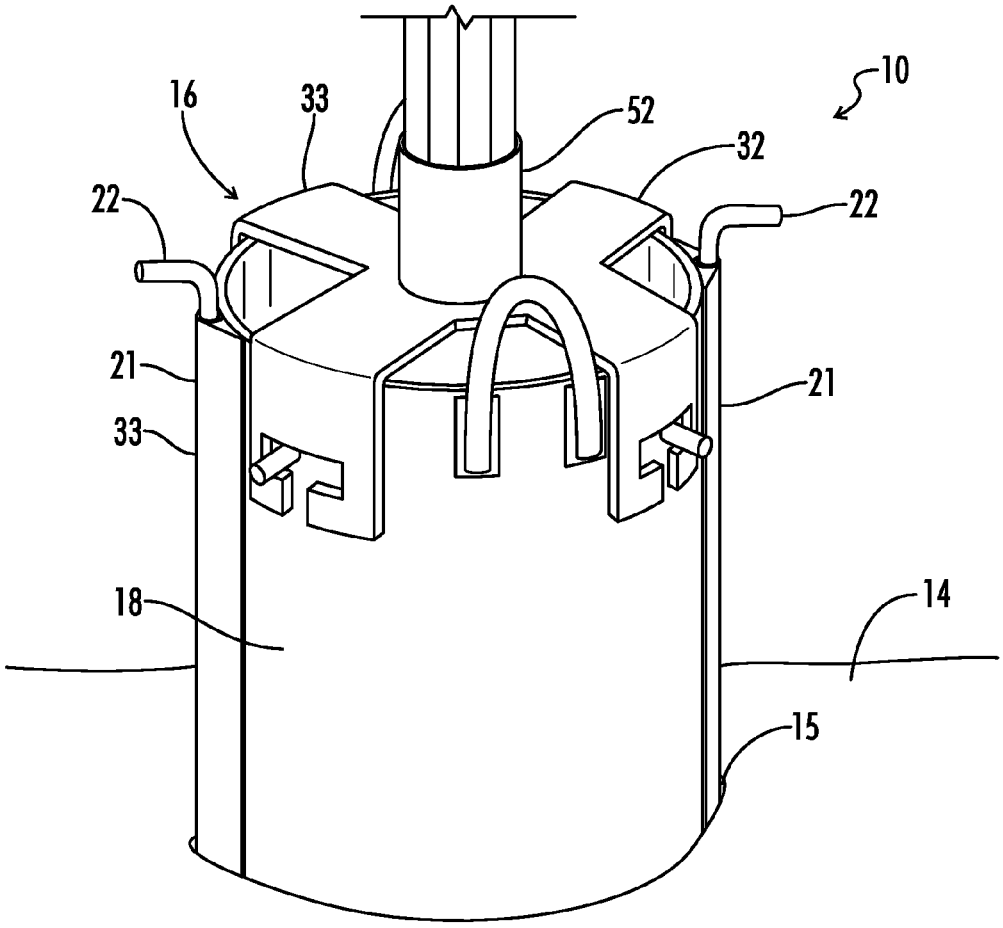
FIG. 11 is a perspective view of an alternate embodiment of an apparatus made in accordance with the current disclosure.

Also included is a top (32) removably engaging each side (16 and 18). The top end includes at least one protrusion (34) shaped to removably engage at least one securing location (36) positioned in each side (16 and 18). The securing location (36) and the protrusion (34) can be numerous combinations of elements known in the art to removably secure two elements. For example, the protrusion (34) can be a pin while the securing location (36) can be a notched opening. Alternately, the protrusion (34) can be a plate while the securing location (36) can be a hole and a fastener (38), such as a bolt, can be used to removably engage the plate and the hole. Alternately, the top (32) can have a securing location and each side can have a protrusion, as shown in FIG. 11. Other combinations of protrusions, securing locations, and fasteners can be used with the scope of this invention.

In an alternate embodiment of the apparatus (10), the top (32) includes arm type extensions (33) that engage each side (16 and 18), as best illustrated FIG. 11. Also included is a protective casing (21) positioned around the connectors (22) to protect the connectors (22) from damage during the burring in the ground (14). These a protective casings (21) can be attached to one of the sides (16 or 18) and overlap the connectors (22) and engage the other sides (16 or 18).

In a preferred embodiment, the first and second sides (16 and 18) each include a substantially semicircular shape, a first vertical edge (40), a second vertical edge (42), a first set (44) of connection apertures (20) positioned proximate to the first vertical edge (40), and a second set (46) of connection apertures (20) positioned proximate to the second vertical edge (42).

Both the first and second sides (16 and 18) include at least one notched opening (37) and a boring edge (26) positioned opposite the notched opening (37). A first connector (48) engages the first set (44) of connection apertures (20) and a second connector (50) engages the second set (42) of connection apertures (20) such that the first and second connectors (48 and 50) removably attach the first side (16) to the second side (18). The first and second sides (16 and 18) reposition the ground (14) and substantially separate the pole (12) from the ground (14) during insertion of the pole (12) into the ground (14). Also, removal of the first and second connectors (48 and 50) allows independent movement of the first and second sides (16 and 18).

A removable top (32) is included, wherein the removable top (32) includes a plurality of protrusions (34) shaped to removably engage the notched openings (37). The top (32) further includes a power transfer fitting (52) positioned on the top (32) to accept rotational power from an external source. This rotational power rotates to the top (32) which in turn rotates the first and second sides (16 and 18). As such, the rotation of the first and second sides (16 and 18) in combination with the boring edge (26) facilitates the boring of the apparatus (10) into the ground (14) to create the initial circumference of the hole (15) that is to be made in the ground (14).

In a most preferred embodiment the diameter of the apparatus (10) is 18 inches which is larger than the standard light pole diameter of 10-14 inches. Additionally, the apparatus (10) is approximately 6½ feet tall.

Referring now to FIGS. 5-10, a preferred use of the apparatus (10) can be described as follows. The apparatus (10) is positioned above the ground (14) at a location in which a hole (15) is to be created. An external power source is used to rotate the apparatus (10) and position the apparatus and press the apparatus (10) into the ground (14) to create the preferred external limits of the hole (15). The top (32) can then be disengaged from the sides (16 and 18) and an earth moving device (54), such as an auger, can be used to remove the internal material (30) to create the hole (15).

Once the earth moving device (54) has removed the internal material (30), a pole (12) can be positioned within the internal circumference of the apparatus (10). Next, each connector (22) can be removed and a handle (17) positioned on each side (16 and 18) can be used to independently remove each side (16 and 18). The pole (12) is then positioned within the hole (15) by itself such that any gap between the edge of the hole (15) and the pole (12) can be filled with suitable filling material to properly secure the pole (12) into the ground (14).

Thus, although there have been described particular embodiments of the present invention of a new and useful Reusable Auger Barrel, it is not intended that such references be construed as limitations upon the scope of this invention except as set forth in the following claims.

Other and further objects, features and advantages of the present invention will be readily apparent to those skilled in the art upon reading of the following disclosure when taken in conjunction with the accompanying drawings.

What is claimed is:

1. An apparatus for insertion of a stanchion into the ground comprising:

a first side including a boring edge, a length, a handle positioned opposite the boring edge, a plurality of connection apertures positioned to open substantially parallel with the length and at least one protrusion;

a second side including a boring edge, a length, a handle positioned opposite the boring edge, a plurality of connection apertures positioned to open substantially parallel with the length and at least one protrusion;

at least one connector removably engaging and passing through the connection apertures of each side to removably engage the first side to the second side and form a perimeter shaped to accept axial forces;

a top removably engaging each side and including a plurality of notched openings, each opening shaped to accept one of the protrusions and impart rotational and axial forces to the sides;

wherein the perimeter is shaped to substantially separate the stanchion from the ground during insertion of the stanchion into the ground; and wherein each handle of each side is positioned and shaped to extend vertically away from the ground after insertion of the apparatus into the ground and accept a vertical force pulling said side of the apparatus from the ground.

2. The apparatus of claim 1, wherein first and second sides define a substantially circular opening when engaged.

3. The apparatus of claim 2, wherein each side includes a length and the connector substantially spans the length.

4. The apparatus of claim 3, wherein the connector vertically connects the first side to the second side along the length.

5. A removable casing for the insertion of a pole into the ground, the pole having a pole portion for insertion into the ground, the removable casing comprising:

a first side and a second side, each side including a length a handle two vertical edges, and a plurality of connection apertures, each connection aperture vertically positioned to open substantially parallel with the length and positioned along one of the vertical edges of one of the sides;

at least two connectors, each connector removeably engaging at least one of the vertically positioned connection apertures of each side, spanning a majority of the length of one of the sides, and removably attaching the first side to the second side and forming a perimeter;

a top removably engaging each side;

wherein the perimeter is shaped to accept an axial force from the top for insertion of the removable casing into the ground substantially the entire length of each side;

wherein the perimeter is shaped to separate the pole portion that is inserted into the ground from the ground during insertion of the pole portion into the ground;

wherein each side includes at least one protrusion and a handle positioned proximate the at least one protrusion, the top includes at least one securing location shaped to removably engage each protrusion and impart rotational movement to each side; and wherein each handle of each side is positioned and shaped to extend vertically away from the ground after insertion of the removable casing into the ground and accept a vertical force pulling said side of the removable casing from the ground.

6. The removable casing of claim 5, wherein engagement between the first and second sides define a substantially circular opening.

7. The removable casing of claim 5, wherein the at least one connector is positioned on the perimeter.

8. The removable casing of claim 7, wherein the two connectors are positioned substantially opposite each other on the perimeter.

9. The removable casing of claim 5, wherein each side further includes a boring edge for boring into the ground.

10. A removable casing for the insertion of a pole into the ground, the pole having a pole portion for insertion into the ground, the removable casing comprising:

a first side and a second side, each side having a substantially semicircular shape, a length, a boring edge, a handle opposite the boring edge, a first vertical edge, a second vertical edge, a first set of connection apertures positioned proximate to the first vertical edge and second set of connection apertures positioned proximate to the second vertical edge, each set of connection apertures positioned to open in a direction substantially parallel with the first or second vertical edge;

a first connector removably engaging and passing through the first set of connection apertures on both the first and second sides and a second connector removably engaging and passing through the second set of connection apertures on both the first and second sides each connector spanning a majority of the length of the first or second side and removably attaching the first side to the second side to form a perimeter shaped to accept an axial force for insertion of the removable casing into the ground substantially the entire length of each side, the perimeter also shaped to substantially separate the pole portion inserted into the ground from the ground during insertion of the pole portion into the ground;

a removable top engaging each side, the top shaped to impart rotational movement to each side;

wherein each side includes at least one securing location, the top includes at least one protrusion shaped to removably engage the at least one securing location and impart rotational movement to each side; and wherein each handle of each side is positioned and shaped to extend vertically away from the ground after insertion of the removable casing into the ground and accept a vertical force pulling said side of the removable casing from the ground.

11. The removable casing of claim 10, wherein removal of the connectors allows independent movement of the first and second sides.

12. The removable casing of claim 10, wherein the first and second connectors are positioned within the perimeter.

13. The removable casing of claim 10, wherein the disengagement of the first and second connectors allows independent removal of the each side.

14. A removable casing for the insertion of a pole into a hole in the ground comprising a first side and a second side, each side having a substantially semicircular shape, a first vertical edge, a second vertical edge, a first set of connection apertures positioned proximate to the first vertical edge, a second set of connection apertures positioned proximate to the second vertical edge, at least one protrusion, a handle positioned proximate the at least one protrusion, and a boring edge positioned opposite the at least one protrusion, each set of connection apertures positioned to open in a direction substantially parallel with one of the vertical edges;

a first connector engaging the first set of connection apertures of each side and a second connector engaging the second set of connection apertures of each side and removably attaching the first side to the second side form a perimeter;

a removable top including a plurality of notched openings shaped to removably engage one of the protrusions to impart rotational and axial forces to the sides;

wherein the perimeter is shaped to substantially separate the pole from the ground during insertion of the pole into the ground;

wherein removal of the first and second connectors allow independent vertical movement of the first and second sides; and wherein each handle of each side is positioned and shaped to extend vertically away from the ground after insertion of the removable casing into the ground and accept a vertical force pulling said side of the removable casing from the ground.

15. The removable casing of claim 14, wherein engagement between the first and second sides maintains the hole during insertion of the pole into the ground.

16. A removable casing for the removal of material to create a hole in the ground, the removable casing comprising:

a first side and a second side, each side having a length, a substantially semicircular shape, a first vertical edge, a second vertical edge, at least one notched opening, a handle positioned proximately the at least one notched opening, a first set of connection apertures positioned proximate to the first vertical edge and second set of connection apertures positioned proximate to the second vertical edge, each set of connection apertures positioned to open in a direction substantially parallel with the length;

a first connector engaging the first set of connection apertures of each side and a second connector engaging the second set of connection apertures of each side, the connection apertures removably attaching the first side to the second side to form a perimeter;

a removable top including plurality of protrusions shaped to removably engage each side and impart an axial force to each side for insertion of the removable casing into the ground substantially the entire length of each side;

wherein the perimeter is shaped to substantially separate the material to be removed from the surrounding ground;

wherein removal of the connectors allows independent movement of the first and second sides; and wherein each handle of each side is positioned and shaped to extend vertically away from the ground after insertion of the removable casing into the ground and accept a vertical force pulling said side of the removable casing from the ground.

* * * * *